US005081855A

United States Patent [19]

Terada et al.

[11] Patent Number: 5,081,855

[45] Date of Patent: * Jan. 21, 1992

[54] SLIDE FASTENER LOCK ASSEMBLY

[75] Inventors: Yasuharu Terada, Uozu; Yoshiyuki Horita, Toyama, both of Japan

[73] Assignee: Yoshida Kogyo K.K., Tokyo, Japan

[ * ] Notice: The portion of the term of this patent subsequent to Jun. 5, 2007 has been disclaimed.

[21] Appl. No.: 538,782

[22] Filed: Jun. 15, 1990

[30] Foreign Application Priority Data

Jun. 16, 1989 [JP] Japan ..... 1-70994[U]

[51] Int. Cl.[5] ..... E05B 67/38

[52] U.S. Cl. ..... 70/68

[58] Field of Search ..... 70/68, 284, 285, 312-318, 70/67; 24/418, 419, 421, 425, 436

[56] References Cited

U.S. PATENT DOCUMENTS

| | | | |
|---|---|---|---|
| 1,680,652 | 8/1928 | Walinsky | 70/68 |
| 2,032,019 | 2/1936 | Jordan | 70/68 |
| 3,186,198 | 6/1965 | Noerrenberg-Sudhaus | 70/74 |
| 3,743,335 | 7/1973 | Reilhac et al. | 292/DIG. 72 |
| 3,973,419 | 8/1976 | Atkinson | 70/68 |
| 4,015,457 | 4/1977 | Fukuroi | 70/68 |
| 4,310,953 | 1/1982 | Nanasi | 24/230 AL |
| 4,343,162 | 8/1982 | Giacometti | 70/67 |
| 4,691,540 | 9/1987 | Murase | 70/68 |
| 4,756,173 | 7/1988 | Yang | 70/68 |
| 4,930,323 | 6/1990 | Terada et al. | 70/68 |

FOREIGN PATENT DOCUMENTS

| | | |
|---|---|---|
| 2127436 | 10/1972 | France . |
| 258258 | 10/1950 | Japan . |
| 33-13798 | 8/1958 | Japan . |
| 62-115476 | 7/1987 | Japan . |
| 808881 | 7/1949 | Netherlands . |
| 1173315 | 12/1969 | United Kingdom . |

*Primary Examiner*—Gary L. Smith
*Assistant Examiner*—Darnell M. Boucher
*Attorney, Agent, or Firm*—Hill, Van Santen, Steadman & Simpson

[57] ABSTRACT

A slide fastener lock assembly comprises a slider pull tab having an engaging pin and a lock having a locking lug releasably engageable therewith. The lock has a latch movable toward and away from the locking lug to lock and unlock the pull tab. A lock tumbler is rotatable by a key to releasably lock the latch with the engaging pin. The pull tab and the lock can be joined together simply by flipping the pull tab down with its aperture fitted over the locking lug.

13 Claims, 5 Drawing Sheets

SLIDE FASTENER LOCK ASSEMBLY

BACKGROUND OF THE INVENTION

1. Field of the Invention

This invention relates to a lock assembly for a slide fastener and more particularly to such a lock assembly which is capable of releasably locking a slider on a slide fastener attached to a garment article.

2. Prior Art

There are known many lock devices of this character, an example of which is disclosed in Japanese Utility Model Publication No. 33-13798 and which comprises an engaging pin formed in the lower surface of a slider pull tab and vertically projecting so as to enter through the upper surface of a lock into hooked engagement with the latter. A disadvantage of this prior art device is that since it is located on the back of the pull tab, the engaging pin cannot be viewed from outside and hence is extremely cumbersome to fit with the lock. Another drawback of the device is found in that the pull tab and the lock when joined together form a junction so stiff and hard as to prohibit their relative movement which is urged by bending stresses applied in different directions especially with the slide fastener attached to a flexible garment article such as bags or similar containers, with the results that the engaging parts of the device receive localized strains and become susceptible to wear and damage.

Another prior art device is disclosed in Japanese Utility Model Laid-Open Publication No. 62-115476 in which a slider pull tab having an engaging aperture is arranged to enter through an opening in the front end of a lock having a locking prong engageable in the engaging aperture of the pull tab. Such device has a drawback in that it is quite tedious to have to align the pull tab with the opening of the lock and therefore the user would often leave the pull tab disengaged from the lock when he thinks it unnecessary to completely lock the slide fastener on a bag or the like, in which instance the bag is apt to open up inadvertently while it is being carried. This prior art device also has the same problem associated with bending stresses as is encountered by the first exemplified prior art.

SUMMARY OF THE INVENTION

It is therefore a primary object of the present invention to provide an improved slide fastener lock assembly which will eliminate the foregoing difficulties of the prior art and which more specifically has such structural features as to enable the user to clearly view the engagement parts of both a slider pull tab member and a lock member and to ensure smooth and positive lock of both members substantially in any angularly tilted position and further to eliminate localized strains at the engagement parts.

The above and other objects and features of the invention will become apparent from the following description taken in conjunction with the accompanying drawings which illustrate by way of example some preferred embodiments.

According to the invention, there is provided a slide fastener lock assembly which comprises a slider pull tab and a lock releasably engageable therewith, the slider pull tab having an engaging pin at one end and an elongate aperture defined by the pin, and the lock having a locking lug dimensioned to receive the aperture, a latch, a spring means normally biasing the latch toward the locking lug in overlaying relation to the engaging pin, a lock tumbler operatively associated with and rotatable to releasably lock the latch with the engaging pin, and a lock release means adapted to unlock the latch from the engaging pin.

BRIEF DESCRIPTION OF THE DRAWINGS

In the accompanying drawings in which like reference numerals refer to like or corresponding parts throughout the several views.

DETAILED DESCRIPTION OF THE INVENTION

Figure 1:
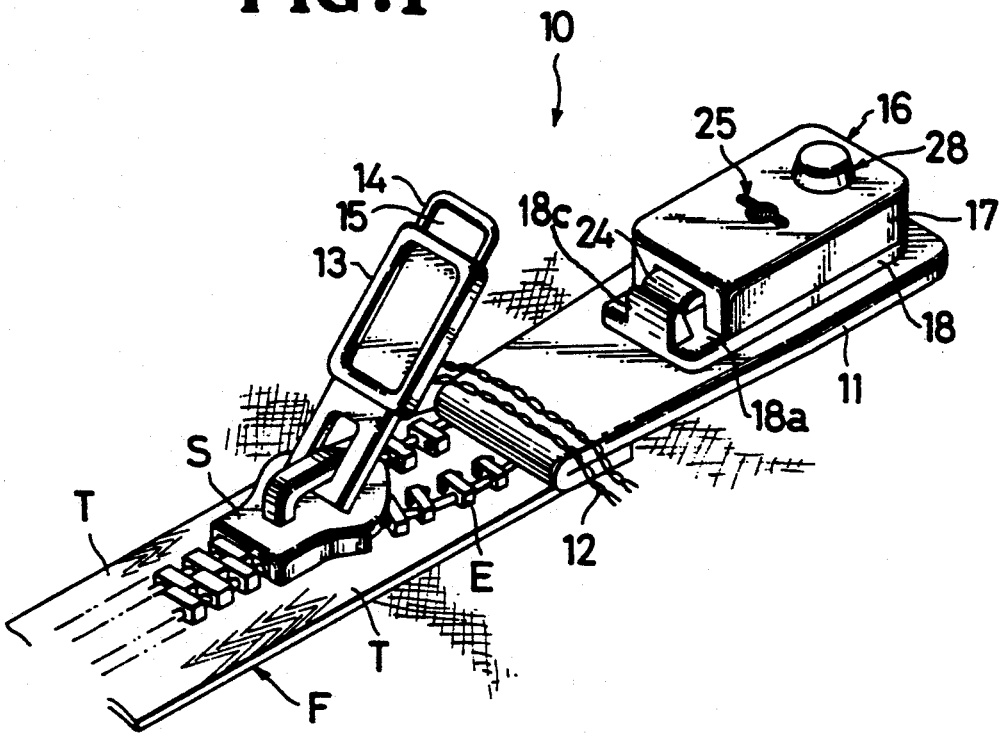
FIG. 1 is a perspective segmentary view of a slide fastener having mounted thereon a lock assembly embodying the invention.
Figure 2:
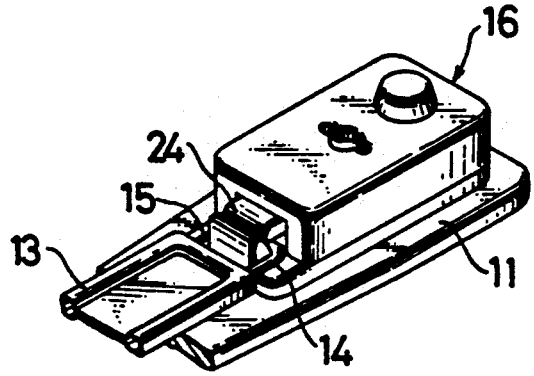
FIG. 2 is a perspective view of the lock assembly shown in locked position.

Referring now to the accompanying drawings and FIG. 1 in particular, there is shown a slide fastener F which comprises a pair of oppositely disposed stringer tapes T, T, each carrying along their respective inner longitudinal edges a row of coupling elements E, and a slider S reciprocably movable to open and close the slide fastener F in a manner well known in the art. A support flapper 11 is secured at one of its ends to an end of the slide fastener F as by sewn seams 12 and has the other free end flappingly disposed. The flapper 11 may be alternatively attached in its entirety to a garment article such as a handbag B shown in FIG. 3.

The slider S includes a pull tab 13 which constitutes one part of a slide fastener lock assembly generally designated 10 embodying the invention and which has one of its ends pivotally connected to a trunnion 14 on the slider body.

The pull tab 13 is provided at the opposite end with an engaging pin 14 projecting from and defining with an extreme transverse edge of the pull tab 13 an oblong aperture 15. The engaging pin 14 is preferably circular in cross section for purposes later described.

Figure 7:
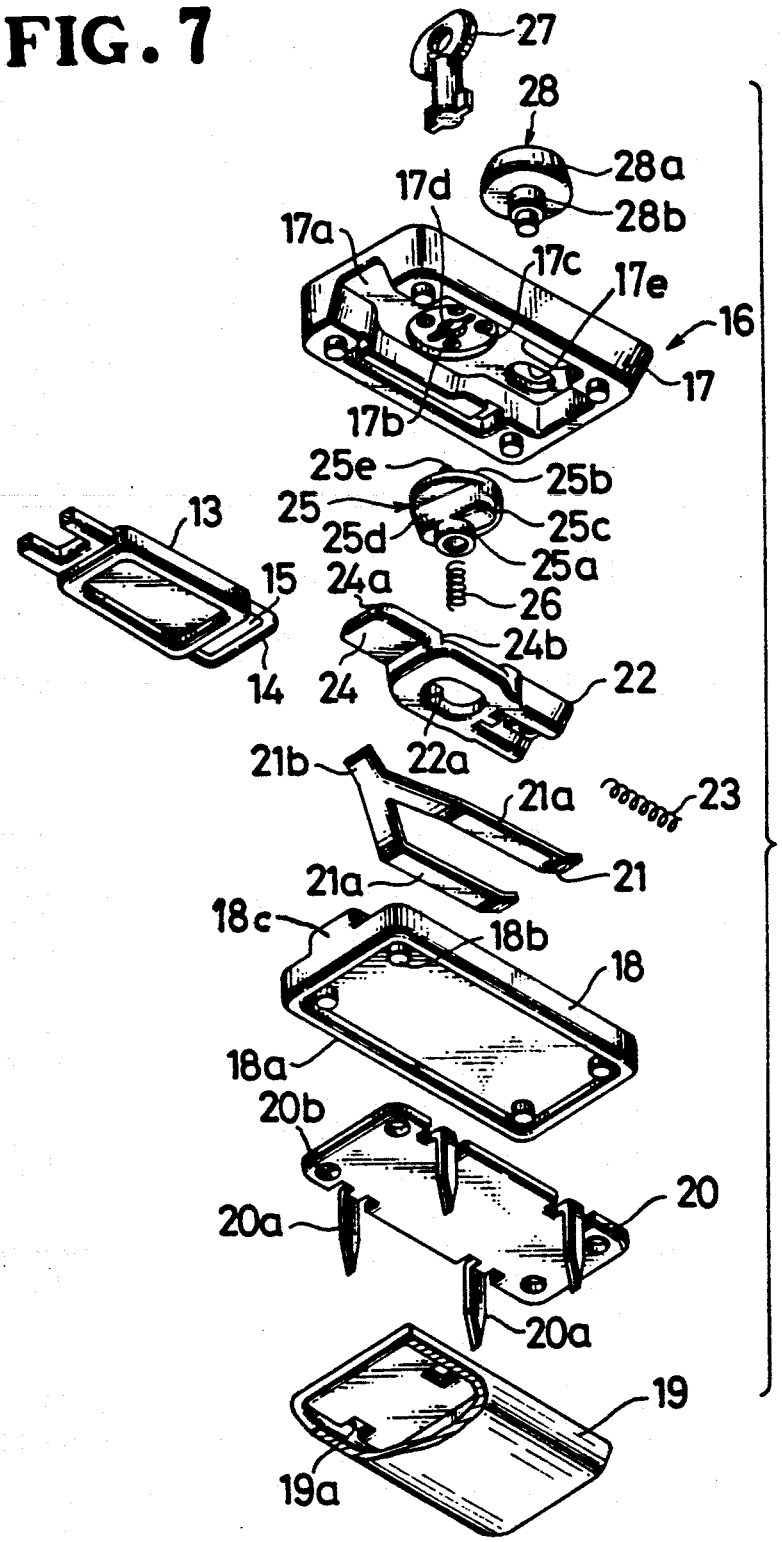
FIG. 7 is an exploded perspective view of the various parts forming the lock assembly.

A lock 16, which constitutes the other part of the slide fastener lock assembly 10, is secured to the upper surface of the flapper 11, and comprises various component parts, better shown in FIG. 7, including a casing 17 having an opening **17*a* directed toward the slider S, a rectangular base plate 18 disposed on the upper surface of the flapper 11 and having a coextensive extension 18*a* protruding beyond an end of the casing 17 confronting the slider S, and a cylindrical backing plate 19 secured to the lower surface of the flapper 11. Interposed between the base plate 18 and the backing plate 19 is a connecting plate 20 having a plurality of rivets 20*a***.

When mounting the lock 16, the rivets 20*a* are thrusted through the flapper 11 and passed through holes 19*a* into the backing plate 19, in which instance the plate 19 serves as an anvil to bend the rivets 20*a* in place. The connecting plate 20 has engaging holes 20*b* for receiving engaging pins 18*b* downwardly projecting from the bottom of the base plate 18. At an end of the base plate extension 18*a* exposed out of the casing 17, there is provided an upwardly extending locking lug 18*c* dimensioned to fit in the aperture 15 of the pull tab 13.

Figure 4:
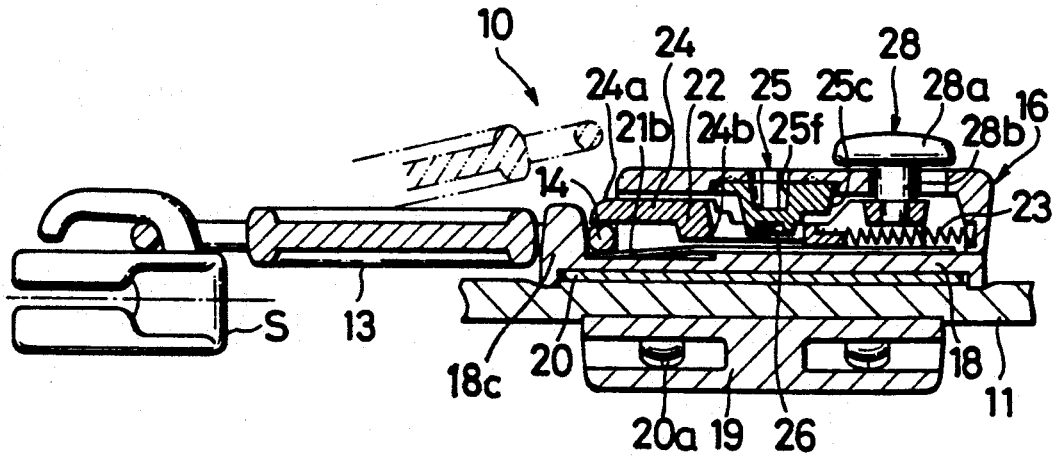
FIGS. 4 through 6 inclusive are longitudinal cross-sectional views of the lock assembly utilized to explain its operation.
Figure 6:
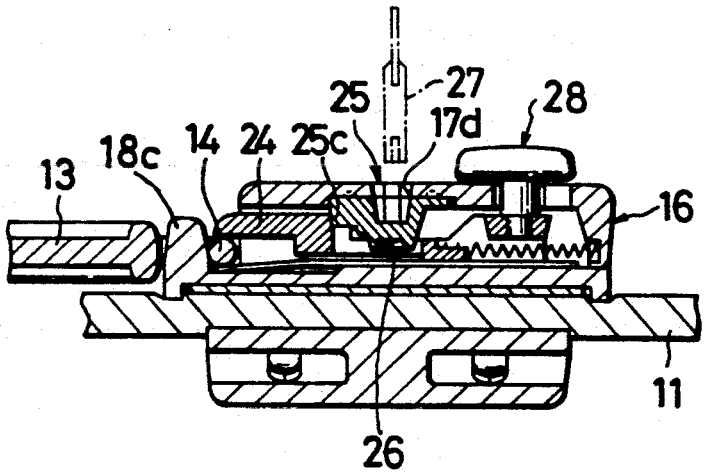

A resilient member 21 such as in the form of a leaf spring is mounted on the base plate 18 and has bifurcated arms 21*a*, 21*a* converging toward and joined together by a neck 21*b* as better shown in FIG. 7, the neck 21*b* being located adjacent to the locking lug 18*c* and engageable with the engaging pin 14 of the pull tab 13 as shown in FIGS. 4 and 6.

Figure 5:
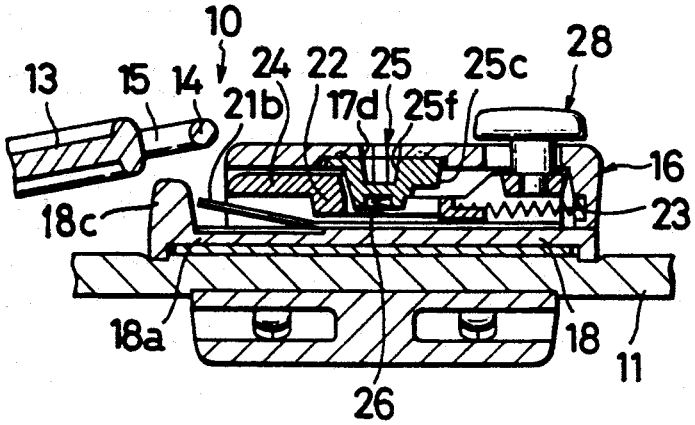

A slide member 22 is slidably mounted within the casing 17 over the resilient member 21 and normally biased toward the locking lug 18*c* by means of a spring 23 connected to one or rear end of the slide member 22. At the opposite or front end of the slide member 22 is a latch 24 integral therewith and having an arcuately shaped transverse end surface 24*a* at one end and a vertical abutment 24*b* as shown in FIGS. 4–6 for purposes later described.

A lock tumbler 25 in the form of a polygonal disc is rotatably mounted in the casing 17 in overlying relation to the slide member 22. The lock tumbler 25 has a small-diameter circular bottom 25*a* received in an elongate longitudinal slot 22*a* formed centrally in the slide member 22 and a large-diameter circular top surface 25*b* fitted snugly in a circular cavity 17*b* formed in the casing 17. A spring 26 is adapted to bias the lock tumbler 25 toward the casing 17. The lock tumbler 25 further includes a semicircular peripheral first cam surface 25*c* and an off-set vertical flat second cam surface 25*d*, the first and second cam surfaces 25*c*, 25*d* being disposed in diammetrically opposed relation to each other as shown in FIGS. 4–6. On the top surface 25*b* of the lock tumbler 25 are formed a plurality of projections 25*e* engageable in corresponding recesses 17*c* formed in the cavity 17*b* of the casing 17. Also formed in the cavity 17*b* is a through-opening 17*d* for receiving therethrough a key 27 which is in turn received in a key hole 25*f* formed in the top surface 25*b* of the lock tumbler 25.

Designated at 28 is a lock release button having a cap portion 28*a* exposed above the casing 17 and a stem portion 28*b* connected through an elongate opening 17*e* in the casing 17 to a rear end portion of the slide member 22 remote from the latch 24.

The lock release button 28 is movable in and along the elongate opening 17*e* to release or unlock the latch 24 from the engaging pin 14 of the pull tab 13.

With this construction, the slide fastener lock assembly 10 operates as follows:

The slide fastener F is fully closed by bringing the slider S into abutting engagement with the flapper 11, whereupon the pull tab 13 is simply flipped down (from the phantom line position in FIG. 4) with its aperture 15 fitted over the locking lug 18*c* of the lock 16. In this instance, the engaging pin 14 being cross-sectionally circular or rounded off can slide down the arcuate surface 24*a* of the latch 24, urging the latter (and the slide member 22) to retract against the tension of the spring 23 and depressing the resilient member 21. Immediately this is done, the latch 24 advances by the action of the spring 23 toward the locking lug 18*c* and retains the engaging pin 14, hence the pull tab 13 in locked position with respect to the lock 16. This locked condition is provisional. To make and maintain the slider S fully and completely locked, the key 27 is turned 180° to bring the first cam surface 25*c* of the lock tumbler 25 into registered contact with the vertical abutment 24*b* of the latch 24 so that the latch 24 remains in overlying relation to the engaging pin 14 of the pull tab 13 as shown in FIG. 6. Turning the key 27 another 180° will bring the second cam 25*d* of the lock tumbler 25 into registry with the vertical abutment 24*b* of the latch 24 to resume a provisional lock condition of the lock assembly 10. The lock release button 28 is then moved backward or toward the right as viewed on the drawings to retract the slide member 22, hence the latch 24 against the tension of the spring 23 so as to release the engaging pin 14 of the pull tab 13, whereupon the resilient member 21 springs back and tosses the engaging pin 14 upwardly out of the lock 16 as illustrated in FIG. 5.

Figure 3:
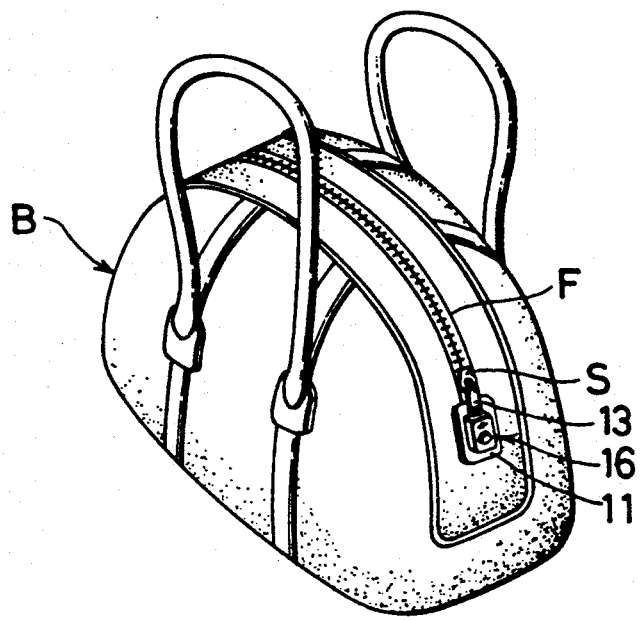
FIG. 3 is a perspective view of a handbag to which a slide fastener is attached with the lock assembly.
Figure 8:
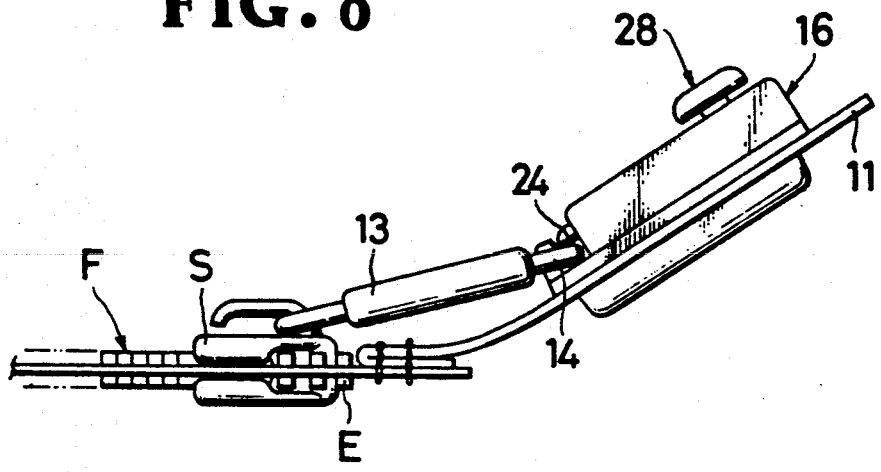
FIG. 8 is a diagrammatic side elevational view of the lock assembly shown subjected to upwardly directed bending stress.
Figure 9:
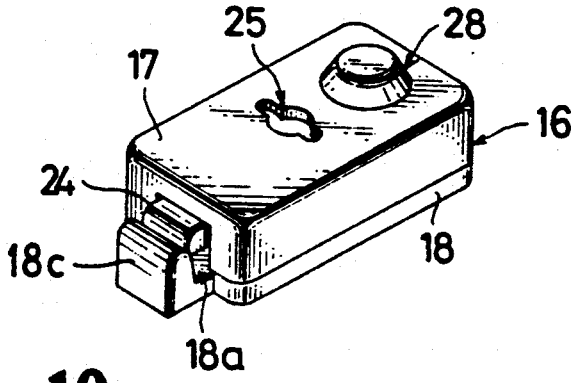
FIG. 9 is a perspective view of a modified lock part of the assembly.
Figure 10:
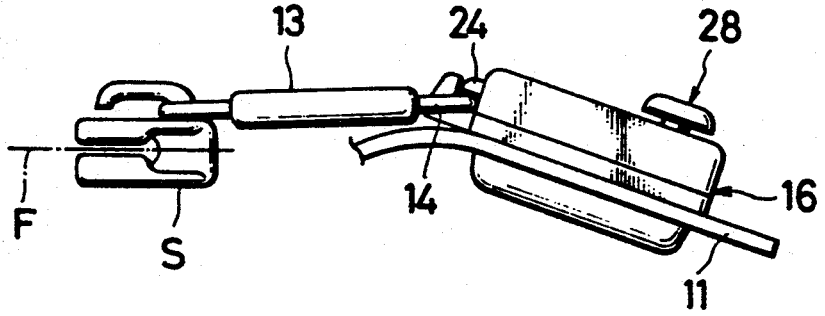
FIG. 10 is a diagrammatic side elevational view of the lock assembly having the lock of FIG. 9 and shown subjected to downwardly directed bending stress.

The slide fastener lock assembly 10 in its locked position on the bag B is often subjected to external stresses tending to flex the flapper 11 up or down. Upwardly directed stresses can be dealt with by relative movement of the pull tab 13 and the lock 16 as shown in FIG. 8. Downwardly directed stresses can also be overcome if the flapper 11 carrying the lock 16 is attached in whole to the bag B as shown in FIG. 3, because such stresses are blocked by the bag B itself without impairing the lock assembly 10. However, the slide fastener F is sometimes left unsewn and free at one end confronting the flapper 11, in which instance the flapper 11 is susceptible to both upward and downward flexing. To solve this problem, the width of the base plate extension 18*a* may be reduced to be equal to that of the locking lug 18*c* or smaller than the length of the engaging pin 14 as shown in FIG. 9, so that the flapper 11 can flex downwardly at the junction between the locking lug 18*c* and the engaging pin 14 in response to downwardly directed stresses as shown in FIG. 10 thereby to eliminate possible damage to the lock assembly 10.

Obviously, various modifications and variations of the present invention are possible in the light of the above teaching. It is therefore to be understood that within the scope of the appended claims the invention may be practiced otherwise than as specifically described.

What is claimed is:

1. A slide fastener lock assembly comprising a slider pull tab and a lock releasably engageable therewith, aid slider pull tab having at one end an engaging pin and an elongate aperture defined by said engaging pin, and said lock including a casing, a base plate underlying aid casing, an extension extending from said base plate and exposed out of said casing toward said pull tab, said lock having a locking lug provided on said extension and dimensioned to receive said aperture, a latch positioned adjacent to and operative with said locking lug for locking said engaging pin, a spring member normally biasing said latch toward said locking lug in overlying relation to said engaging pin, a lock tumbler rotatable to releasably lock said latch with said engaging pin, and a lock release means adapted to unlock said latch from said engaging pin.

2. A slide fastener lock assembly according to claim 1 wherein said engaging pin is cross-sectionally circular or otherwise rounded off and said latch has an arcuately shaped end surface.

3. A slide fastener lock assembly according to claim 1 wherein said lock tumbler has a first cam surface and a second cam surface in diammetrically opposed relation to each other, said first cam surface being engageable with said latch to lock the latter with said engaging pin, and said second cam surface being engageable with said latch when the latter is released from said engaging pin by said lock release means.

4. A slide fastener lock assembly according to claim 3 further including a key adapted to turn said lock tumbler 180° to register said first cam surface with said latch and another 180° to register said second cam surface with said latch.

5. A slide fastener lock assembly which comprises a slider pull tab and a lock releasably engageable therewith, said slider pull tab having an engaging pin at one end and an elongate aperture defined by said pin; and said lock having a casing with an extension extending outward of said casing toward said pull tab, a locking lug dimensioned to receive said aperture wherein said extension is equal in width to said locking lug, a latch, a spring means normally biasing said latch toward said locking lug in overlying relation to said engaging pin, a lock tumbler operatively associated with and rotatable to releasably lock said latch with said engaging pin, and a lock release means adapted to unlock said latch from said engaging pin.

6. A slide fastener lock assembly according to claim 1 further including a resilient member normally biasing said engaging pin upwardly toward said latch.

7. A slide fastener lock assembly according to claim 1, wherein aid extension has a width equal to said locking lug.

8. A slide fastener lock assembly according to claim 1, wherein said extension has a length smaller than said engaging pin.

9. A slide fastener lock assembly having a slider pull tab and a lock releasably engageable thereto, said slider pull tab having at one end an aperture; and said lock comprising:

a base plate, a casing overlying a portion of said base plate, an extension extending in planar fashion from said base plate outside of said casing, on a side of said lock toward said pull tab, a locking lug arranged on said extension upwardly and in perpendicular fashion to said extension, said aperture sized to receive said locking lug therethrough, a latch positioned adjacent to, and operative with, said locking lug for locking said pull tab onto said extension with said locking lug piercing said aperture, a spring member biasing said latch toward said locking lug to overlie a distal end of said pull tab, a lock tumbler rotatable to releasably lock said latch overlying said distal end portion of said pull tab, and a lock release means for releasing said lock from said latch.

10. A slide fastener lock assembly according to claim 9, wherein said aperture is defined by a U-shaped pin mounted at the distal end of said pull tab.

11. A slide fastener lock assembly according to claim 10, wherein said U-shaped pin comprises a round cross sectional shape and said latch comprises a rounded distal end on a surface of said latch facing away from said base.

12. A slide fastener lock assembly according to claim 10, wherein said extension comprises a width at least as narrow as said locking lug.

13. A slide fastener lock assembly according to claim 12, wherein said aperture of said pull tab comprises a length at least as great as a maximum thickness of said locking lug, said length and said maximum thickness measured in a plane along an approach of the slider pull tab toward the lock as the pull tab is brought into engagement with the lock to be latched therewith.

* * * * *